United States Patent [19]

Dickinson

[11] Patent Number: 4,625,486

[45] Date of Patent: Dec. 2, 1986

[54] LAMINATED VAPOR BARRIER MATERIAL AND METHODS OF USE

[76] Inventor: Thomas C. Dickinson, 205 Fifth St., Hackettstown, N.J. 07840

[21] Appl. No.: 693,469

[22] Filed: Jan. 22, 1985

[51] Int. Cl.[4] ..... E04B 1/74; A47H 1/14; E04G 3/00

[52] U.S. Cl. ..... 52/404; 428/252; 428/284

[58] Field of Search ..... 52/404, 407; 428/40, 428/251, 252, 284, 906

[56] References Cited

U.S. PATENT DOCUMENTS

| | | | |
|---|---|---|---|
| 2,189,409 | 11/1937 | Sibley | 428/175 |
| 2,788,053 | 4/1957 | Dolbey et al. | 52/809 |
| 3,238,681 | 3/1966 | Vivio | 52/404 |
| 3,343,227 | 9/1967 | Brown | 52/404 |
| 3,979,537 | 9/1976 | Troyer | 52/404 |
| 4,233,791 | 11/1980 | Kuhl et al. | 52/404 |
| 4,333,292 | 6/1982 | Musgrave | 52/404 |
| 4,390,585 | 6/1983 | Holden | 428/251 |
| 4,391,075 | 7/1983 | Musgrave | 52/404 |
| 4,435,466 | 3/1984 | Kuhnel | 428/251 |
| 4,468,422 | 8/1984 | Siener et al. | 428/193 |

FOREIGN PATENT DOCUMENTS

| | | | |
|---|---|---|---|
| 1105247 | of 1955 | France | 52/404 |

*Primary Examiner*—William F. Pate, III
*Assistant Examiner*—John Malcolm White
*Attorney, Agent, or Firm*—Eugene E. Renz, Jr.

[57] ABSTRACT

A laminated vapor barrier for building insulation including a vapor impermeable bottom sheet and an uppermost backing sheet with an intermediate strengthening fiber array constituted by a plurality of layers of strips of crossedly disposed synthetic fibers, a plurality of spaced and laterally disposed thin supporting strips of a suitable material intermediate the fiber array layers and the bottom facing sheets, a preferably fire retardant adhesive interconnecting all layers into a cohesive self-supportive layered and laminated vapor barrier product, the product being adapted for operatively supporting layered insulating material to the interior underside of a metal building roof structure, or the like, having a plurality of spaced longitudinally extending purlins, interconnected with the building structure, a plurality of supporting hangers depending from the purlins, the vapor barrier material being interengaged with and mounted to the hangers by interengagement support between the supporting strips and supportive hangers, the vapor barrier, as installed, actively preventing moisture intrusion from a building interior from contacting and possibly penetrating the layered insulation material.

12 Claims, 10 Drawing Figures

50
58
66
64
54
60
62
6
7
68
22
24
28
16
38
14
18
70
68a
74
48
46
44

LAMINATED VAPOR BARRIER MATERIAL AND METHODS OF USE

BACKGROUND OF THE INVENTION

1. Field of the Invention

The present invention broadly relates to insulation as utilized in building structures, primarily of a metal material, and in which it is desired to provide, either during initial construction, or subsequent to complete construction of the building, having mounted thereover a roof, usually of metal, as an addition, a vapor barrier for that insulation. The vapor barrier serves to preclude penetration of moisture into insulation material, from the interior of the building. The vapor barrier of the invention is applied externally of insulation within the building, to protect the insulation from moisture and/or humidity.

The invention is directed primarily to metal buildings utilizing metal roof structures having therebelow insulation material such as fiberglass, or others, which is supported in various known manners. Obviously the features of the invention are more broadly applicable than as specifically applied to special types or construction of metal buildings.

Numerous attempts have been made to devise a material structure, which can be referred to as a vapor barrier, and which is applied externally to insulation within a building, primarily of metal, to protect the insulation from moisture or humidity. Some known constructions have attempted to solve multiple problems existing in the art. It is essential, however, that the insulation be protected by a vapor barrier from moisture penetration, and which is preferably at the same time fire retardant, and must have a desired perm rating, which is a measure of how much moisture vapor can pass through the barrier to the insulation and which will be satisfactory in the industry. Industry heretofore has provided different facing types which on an industrial insulation essentially prevent diminishing, or complete destruction of the insulating value of insulating material due to the insulation becoming moist or wet.

A primary consideration of the present invention concerns the metal building insulation market. Metal buildings, subsequent to World War II, have been substantially increasing, many of them having little or no insulation. Current practice is to insulate the metal building just prior to the roof sheets being applied. Faced insulation of some constructions is usually rolled over the purlins, a type of supporting beam, and then the external flat roof sheets are placed over the insulation. These sheets trap or secure the insulation and it then becomes permenant part of the building.

OBJECTS OF THE INVENTION

The present invention serves to solve problems which arise when trying to insulate a building where the roof sheets are already secured down and no insulation has been applied. It can also be used to insulate an existing building where some insulation may or may not be present. As is well known, the addition of new or added insulation is a very beneficial move in buildings, since it can cut down tremendously on fuel bills, while increasing the comfort of the atmosphere within the building for workers or tenants. It has been found, however, that if an attempt is made to add insulation from the underneath interior of a building, instead of above, the problem arises of means for suspending the added insulation.

Numerous systems have been devised, hopefully to suspend or secure such new insulation by working from below the roof.

The present invention teaches a new and highly efficient method of creating a vapor barrier, and method of insulation of existing buildings which have been completed but contain less insulation than desired, or none at all, and the invention uses a vapor barrier sheeting which also importantly serves as suspension means and as a supportive structure for added or newly installed insulation.

The invention teaches a product which is a good vapor barrier material and which is of a structure whereby it can be used to support either new or additional insulation material, and certain features thereof ensure that a minimum or no openings or perforations exist which might involve areas for seepage loss of energy, or for introduction of moisture to installed insulation. As pointed out above, introduction of moisture into known insulation materials tends to either substantially decrease, or to completely remove the effective insulation values and/or destroy the material. Some existing types of constructions allow moisture to seep around edges, or if sagging of the material is permitted at the ends or other areas, openings can be created through which moisture can enter the insulation material. The present invention teaches a vapor barrier material as a product per se, or which is useable in older constructions, which is highly effective and includes edge sealing means where the material or product is applied in adjacent strips. Edge sealing means isolate the insulation material from moisture-laden air. Sagging or other deformations or deterioration of the material used may be inhibited by the present invention.

Numerous proposals have been made attempting to solve at least some of the problems arising through installation of insulating material, or in an attempt to increase the insulation in existing structures. For the most part, these prior attempts have not been entirely satisfactory.

Examples of previously known attempts to solve the problems can be found in the following issued U.S. Patents:

| Inventor | U.S. Pat. No. | Issue Date |
|---|---|---|
| Fischer et al | 4,044,521 | Aug. 30, 1977 |
| Alderman | 4,047,345 | Sept. 13, 1977 |
| Kessler | 4,069,636 | Jan. 24, 1978 |
| Greengrass | 4,096,304 | June 20, 1978 |
| Wells | 4,117,641 | Oct. 3, 1978 |
| Alderman | 4,147,003 | Apr. 3, 1979 |
| Kuhl et al | 4,233,791 | Nov. 18, 1980 |
| Interlante | 4,251,972 | Feb. 24, 1981 |
| Smith | 4,282,276 | Aug. 4, 1981 |
| Kusenda | 4,290,250 | Sept. 22, 1981 |
| Clemensen et al | 4,303,713 | Dec. 1, 1981 |

As will appear from this application, the present invention for the most part solves existing or known problems or drawbacks of prior art constructions, and is applicable in both new and old constructions to give the desired end results; i.e. protection of the insulating material from moisture, heat and fire.

BRIEF DESCRIPTION OF THE DRAWINGS

The accompanying drawings illustrate preferred embodiments of the invention, and when taken together with the following description, serve to explain the principles and the structure of the invention. In the drawings.

SUMMARY OF THE INVENTION

The present invention accordingly teaches a new vapor barrier form which is in roll form, and which can be applied to structures of metal; i.e. metal material buildings, and either to new structures and/or to increase insulation in previously built structures.

The vapor barrier material is in a rolled sheet form and has characteristics whereby adjacent sheet juncture points are so sealingly engaged, that the formation of gap or leakage areas, or deformations, are eliminated. In one form of the invention, edge strips of contact adhesive are used and, in assembly, the edges are overlapped so that the edges are adhesively adhered one to another.

The vapor barrier, referred to in some instances hereinafter as a facing, is applied externally to insulation material to protect the insulation from moisture or humidity.

Some of the above features are individually known in the art. The present invention is particularly deviced to incorporate, in both new and existing structures, a vapor barrier material, and a method of use which overcomes many drawbacks in the previous constructions, and the combined overall effect is highly satisfactory.

The invention achieves improved results by incorporating a support system into the facing material per se. The invention teaches a vapor barrier material or facing having improved basic physical qualities and a modification increasing supportive usage by inserting a supportive strip across the width of the facing, and which strip may be several inches wide, and made of material strong enough to act as a supporting member to hold the insulation above it. These strips are disposed on or integrated within the material at desired spacings and are connectable with mounting means, which can cosist of hangers adapted for support from and extending downward from purlins used in the building structure, or if desired other specifically different types of clips or bolt-type fasteners can be attached to the purlins and interconnected with the vapor barrier material to attach and support it. In some forms of installation prefabricated openings can be provided for mating with different types of supportive fasteners. Reference will hereinafter be made to some possible modifications useable with the invention. The various supportive strips, and methods of overall attachment will be specifically described with reference to the accompanying drawings.

DESCRIPTION OF THE PREFERRED EMBODIMENT

Referring now specifically to the drawings, it is pointed out that FIGS. 1–4 inclusive are directed to the product of the vapor barrier material or sheet per se, whereas the remaining drawings relate to the addition or installation of insulation and, of a vapor barrier, to the inside of new or existing buildings, and can be applied to buildings in use. The present invention is directed primarily, in this aspect, in adding a vapor barrier with insulation to either new or existing structures.

Figure 1:
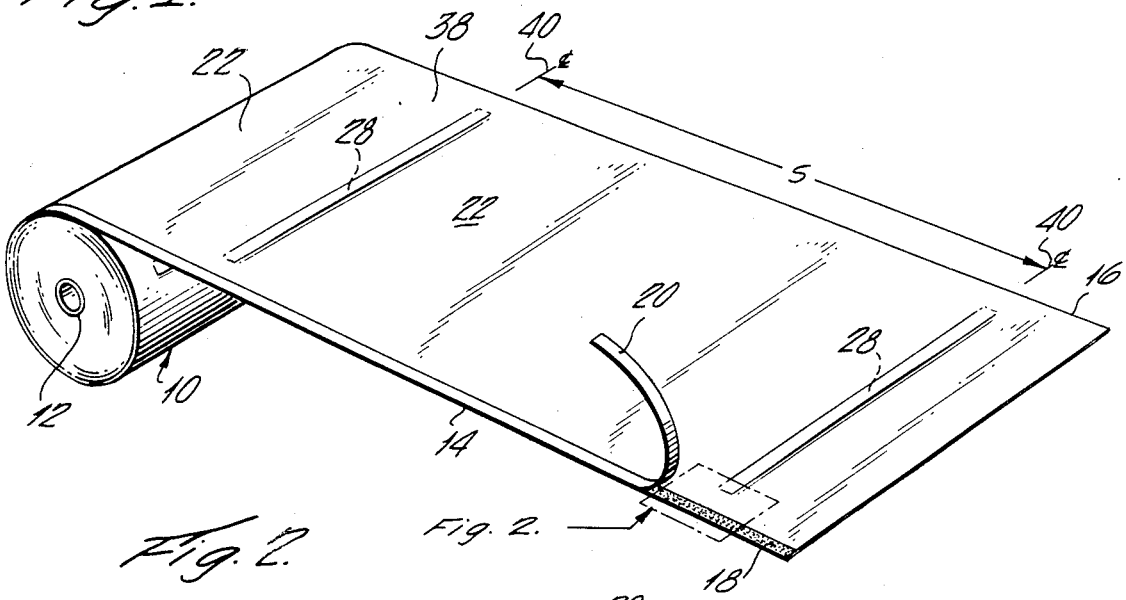
FIG. 1 is a perspective view illustrating a roll of vapor barrier material in accordance with the invention, the material having a treated edge which is adhesively adjacently interconnectable in a sealing manner, and serve to prevent moisture penetration to the insulation from the interior of a building in which installed.
Figure 2:
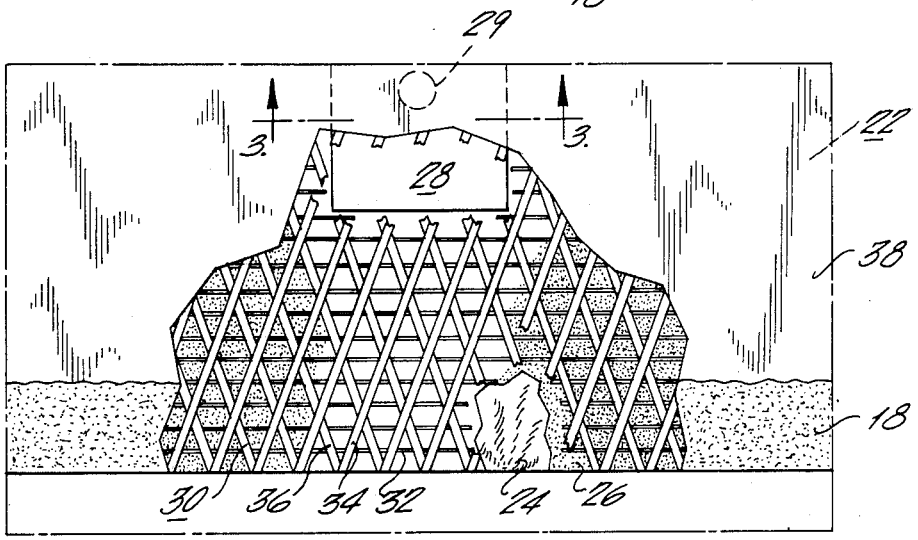
FIG. 2 is an enlarged fragmentary plan view of the area contained within the broken line rectangular box designated FIG. 2 in FIG. 1.
Figure 3:
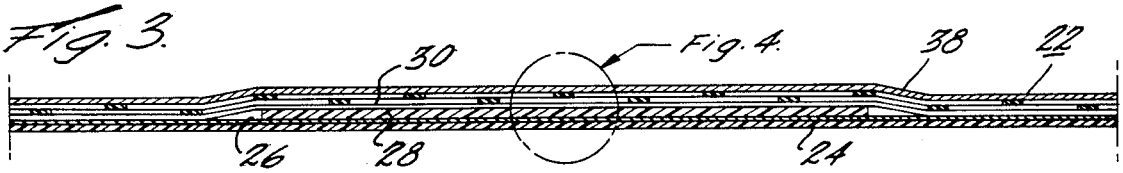
FIG. 3 is greatly enlarged, semi-schematic, sectional elevational view taken on line 3—3 of FIG. 2.
Figure 4:
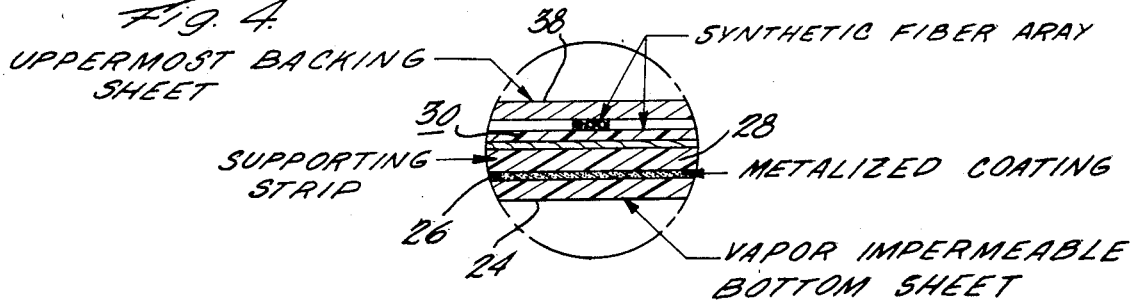
FIG. 4 is a fragmentary enlarged sectional elevational view of the details contained within the broken line circle of FIG. 3, and designated FIG. 4.

Referring now to FIG. 1, there is illustrated a roll 10 of vapor barrier material which is wound on a cardboard mandrel 12 in a known manner. The material itself can be removed from the mandrel as installation occurs or, if desired, separate strips or sections could be cut from the roll of material. The material shown in FIG. 1 includes two side edges 14, 16, and along edge 14, or both there is applied a contact adhesive strip 18. For protective purposes, a peel-off protective strip 20 is over the adhesive strip and, as will appear hereinafter, during installation it is necessary to peel off the cover strip to expose the adhesive strip.

Sections along the length of the sheet of material, are designated 22, and conjointly constitute the vapor barrier as an entity. This vapor barrier consists of a plurality of layers of material unitized by adhesive. This feature of the invention is expanded in the following description of FIGS. 1–4 inclusive. It will be noted that the plural layers, referring to FIGS. 2, 3 and 4 include a bottom facing sheet 24. This facing sheet can be of different known materials such as vinyl, polyesters, polypropylenes, aluminum foil, and/or the like. This sheet constitutes the bottom or outer face which is exposed in the interior of a building within which used. Known in the art is the use of white vinyl to give a finished appearance. A metalized coating 26 is sometimes applied to the inner side of the sheet 24. This increases the moisture repellent properties of the material. Thin supporting strips 28 of a suitable material are positioned on the inner surface. These supporting strips 28 are placed in the lamination at spaced intervals along the length thereof, with the center line spacing being indicated by S in FIG. 1. The inclusion and function of these strips is extremely important to the invention, and serves to strengthen the material at spaced intervals. The strips extend laterally of the web or sheet. These supporting strips 28 also serve for coacting with possibly variable forms of mounting means.

Overlying the plastic supporting strips there is a synthetic fiber array 30. This array includes three layers of integrated synthetic material, and by reference to FIG. 2 it will be noted that the array consists of horizontal strips 32, and fiber strips 34, 36 arranged, for example, in a diagonal or square pattern, and which serve the purpose of strengthening the overall sheet constituting the vapor barrier. Mounted on top of the synthetic fiber array is a paper backing sheet 38 which can consist of Kraft paper or other similar materials of desired characteristics and strengths. The overall cross section of the multiple layers of material is clearly shown in FIGS. 2, 3 and 4.

The various components constituting the laminated vapor barrier sheet 22 are all assembled by means of adhesive material preferably of a fire retardant nature, and each of the component adds its singular effect to the whole array. Referring to FIG. 1, it is to be noted that the stiffening or strengthening inserts or supporting strips 28, preferably of thin plastic material, are positioned with center lines 40 spaced at predesignated intervals of the sheet.

Figures 5, 8:
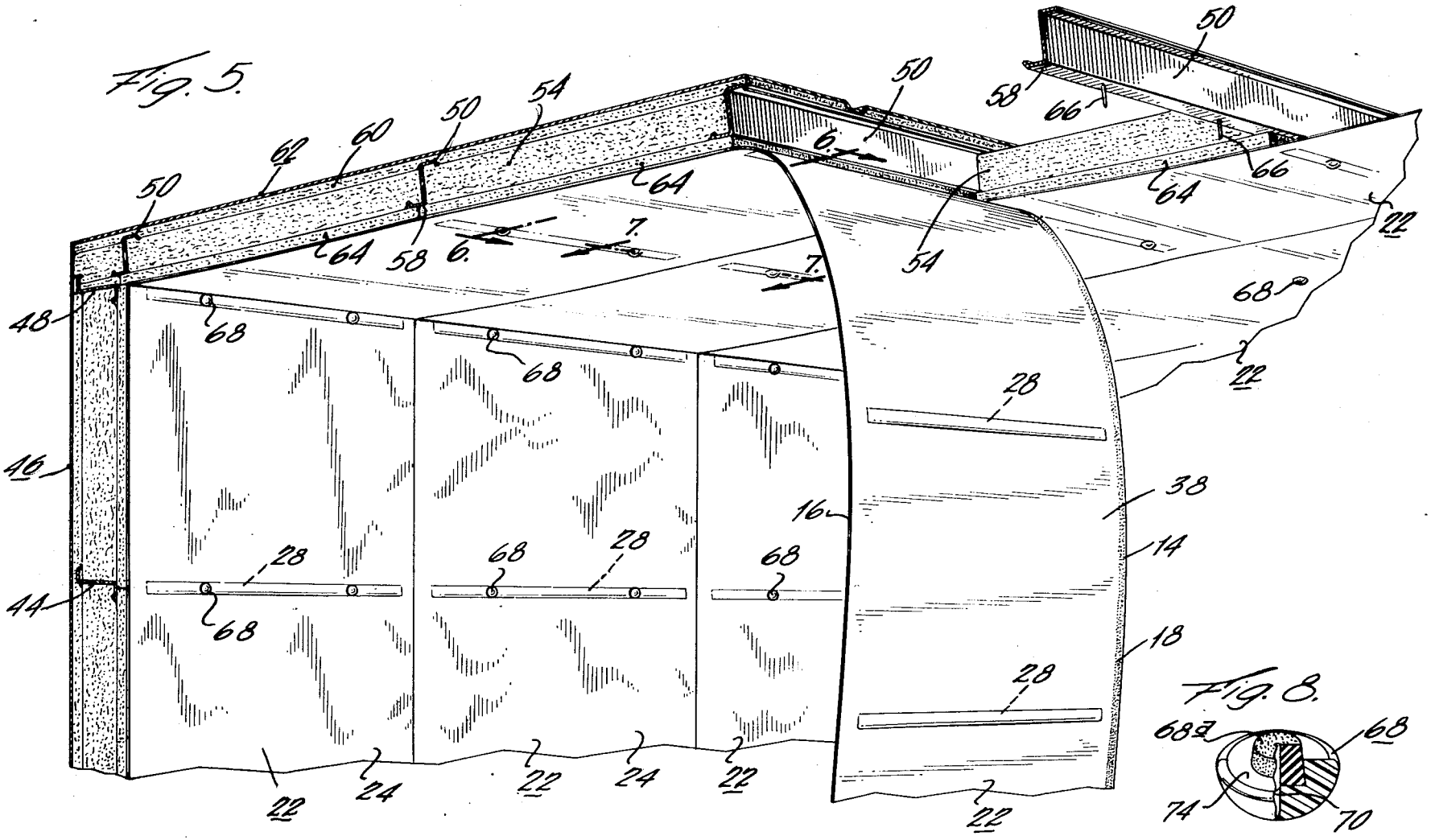
FIG. 5 is a fragmentary perspective view of a portion of an existing installed modern sheet-metal structure, showing use therein of the vapor barrier of the invention, as applied to an existing structure and wherein the facing runs perpendicular to purlins of the building.
FIG. 8 is a perspective view, partially broken away and partially in section, showing details of construction of a non-heat transferring and moisture sealing hanger cap, useable in one form of the invention which has hanger spikes suspended on purlins for installation of the vapor barrier sheet material.
Figure 6:
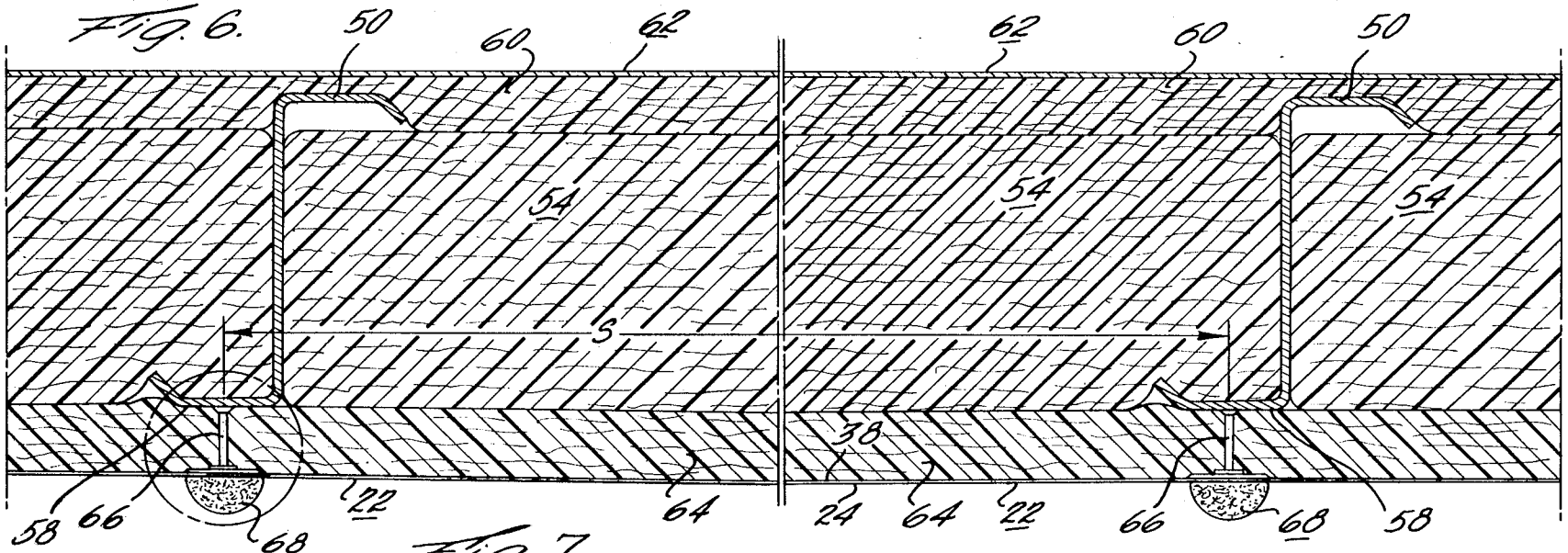
FIG. 6 is an enlarged fragmentary transverse sectional view taken on line 6—6 of FIG. 5.
Figure 7:
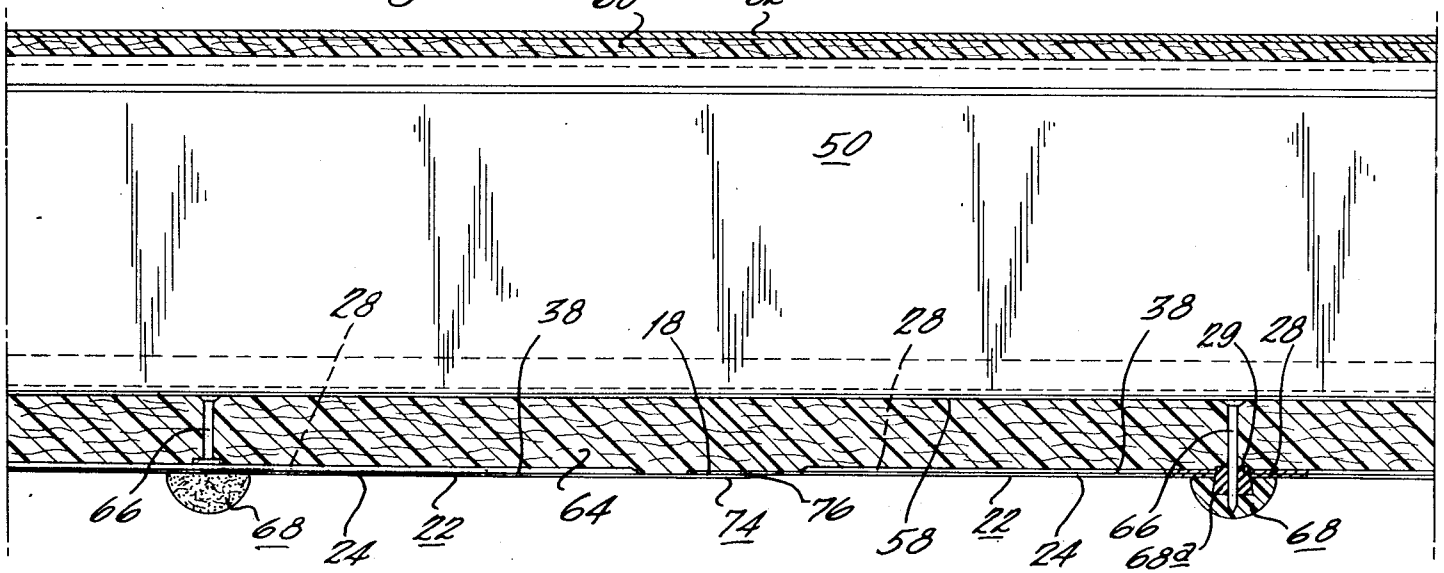
FIG. 7 is an enlarged fragmentary sectional elevational view taken on line 7—7 of FIG. 5, and showing one form of a structure which overcomes problems resulting due to sag of material as installed, such as a parabolic-type sag configuration.

The use or installation of the vapor barrier sheet in one form is shown in FIGS. 5–7 inclusive. Referring to FIG. 5, a representative building structure as shown and is a metal building which can consist of a plurality of spaced arches, generally with longitudinally purlins 44 in vertically spaced position which conjointly form side walls 46 of the building structure. At the upper ends of the side walls there are top purlins which extend longitudinally, as indicated at 48, and which form the upper and outer edge of the construction. The various purlins as aforementioned, and a plurality of roof support purlins 50, are all brought together to comprise an integrated framework structure for the building, and this construction is shown in FIG. 5. The lengthwise purlins 50 constitute means for supporting top insulating material 60 and other layers such as, for example, layer or batt 54 of insulating material.

This is clearly seen in FIG. 5, and can either be preconstructed or previously constructed building having the insulating material or layer 54 mounted therein. This drawing figure also serves to show a new building construction in which insulating layer 60 has been mounted and partially supported by the purlins. Additional insulating material, and the vapor barrier material can be added either to a new or pre-existing structure. A top insulating layer 60 can be laid over the top of the purlins as shown in FIG. 5.

Roofing sheets 62 are positioned above the layer 60 and fastened in place in a usual manner. These roofing sheets are of metal, and in certain locations pose the problem of transmittal of thermal energy. In this arrangement the top of the longitudinal roof purlins are spaced from the roofing sheets by means of the upper or top insulating layer 60. The heat accordingly cannot be transferred from the building interior through the purlin and roof sheets to the building exterior because of a lowermost layer 64 placed below and attached under the purlins. The precise structure of the barrier sheet 22 has been described in detail hereinabove. It is to be noted that contact is made between the bottom leg of the longitudinal roof purlins and the support strips 28 in the vapor barrier 22 through means of hangers or clips.

The sheet material constituting the vapor barrier as shown in FIG. 1 can be mounted between adjacent/parallel purlins or beams 44, and these contiguous or adjacent sheets 22 will then form an interior side wall, as well as ceiling structures as seen in FIG. 5 wherein the side walls have been erected, and the vapor barrier material is being applied to and connected with the undersides of the longitudinal roof purlins. One method of attachment of the vapor barrier sheet to the purlins is shown in FIGS. 5, 6 and 7 wherein hanger spikes 66 are fastened to the undersides of the bottom legs of the purlins. These spaced spikes 66 are adapted to penetrate into and through the vapor barrier sheet 22, and will penetrate at the location or position of an imbedded supporting strip of thin material indexing with circular punch-outs 29. These strips are pushed on to the lower ends of the spikes or other hangers which then penetrate through the various layers constituting the vapor barrier material and serve as supporting means therefor.

In order to ensure that the insulating material and vapor barrier material, in this form of the invention, will be maintained on the hanger spikes, fastening devices such as caps 68 are frictionally mounted on the exposed lower ends of hanger spikes 66, as shown in greater detail in FIGS. 6 and 7. The caps are comprised of non-heat conductive material such as, for example, urethane or polystyrene or the like. Preferably a preformed frictional fit mounted bore 70 is provided in the caps, and when placed on the hanger spikes will frictionally engage thereon and support the vapor barrier sheet. The inner face 72 of the caps is planar and has an adhesive coating 74 thereon. When assembled on a spike and pressed upwardly into engagement with the lower surface of the facing sheet 24, the adhesive material will sealingly or fasteningly engage the lowermost surface of the facing sheet and the assembly is thereupon completed and supported. The fastener may be of another type and configuration. For example, it may comprise a metal disc having a central opening which frictionally secures to the hanger spike 66.

The aforementioned assembly can be used in an existing structure which can include fiberglass or ther insulating material batts superimposed as shown in FIGS. 5 and 6, and to which it is desired to add additional insulating material by means of the layer 64 and an underlying vapor barrier. The lowermost vapor barrier sheet can, in a new installation, provide support means in part for the upper insulating batt 54. The use of the hanger spikes and fasteners is only one method of affixing the various layers of material in place. In this structure attention is invited to FIGS. 5 and 7. In FIG. 7, for example, a juncture point or area **74*a* consists of the edges of adjacent sheets 22 with the adhesive edge of one and the dry edge of the other, each being overlapped as indicated at 76. When assembling adjacent sheets of material in this manner, the cover strip 20** is peeled off the adhesive strip and the sheets are interengaged.

The structure as completed, whether a new construction or an old one having additional fiberglass layers of insulating material, can be fabricated in the same manner. Preexisting buildings usually do not already have the batt 54 mounted therein. Subsequent insulation addition could include placement of the batt such as at 54, between purlins, and a bottom layer 64 added and supported by various hanger means from the under side of the metal roofing structure. The vapor barrier sheet can then be mountedly positioned by mounting on the hangers with the interposition of a further batt 64 of insulating material if desired. The vapor barrier sheet can serve as a mounting and supporting sheet for this lower layer. The batt of insulating material can be affixed on the hangers or spikes. This serves to space the vapor barrier sheet away from the purlins and prevents heat transfer. The vapor barrier sheet is applied over the external surface of the insulating material, with the supporting strips being lined up with the hangers on the purlins when assembling. Subsequently the retaining means such as fasteners 68, in this form of the invention, are pressed on to the spikes.

The foregoing description as applied to the form or structure shown in FIGS. 1–8 inclusive can be changed or the installation and structure varied while maintaining the principles of the invention.

Figure 9:
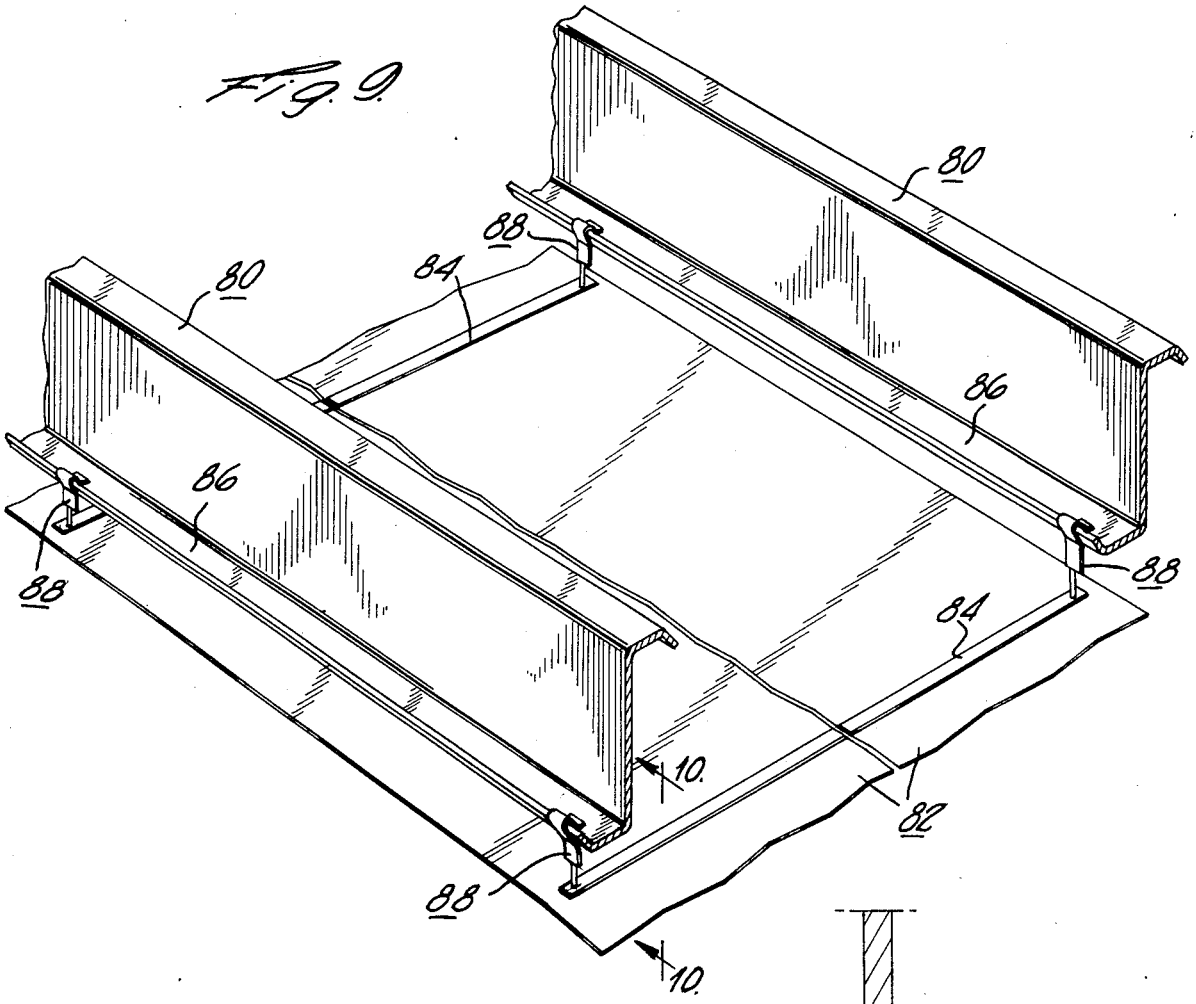
FIG. 9 is a view similar to FIG. 5, of another form of installation of self supporting facing according to the invention, wherein the facing runs in a direction parallel to the building purlins, and with another form of hanger and omitting the other material layers for clarity.
Figure 10:
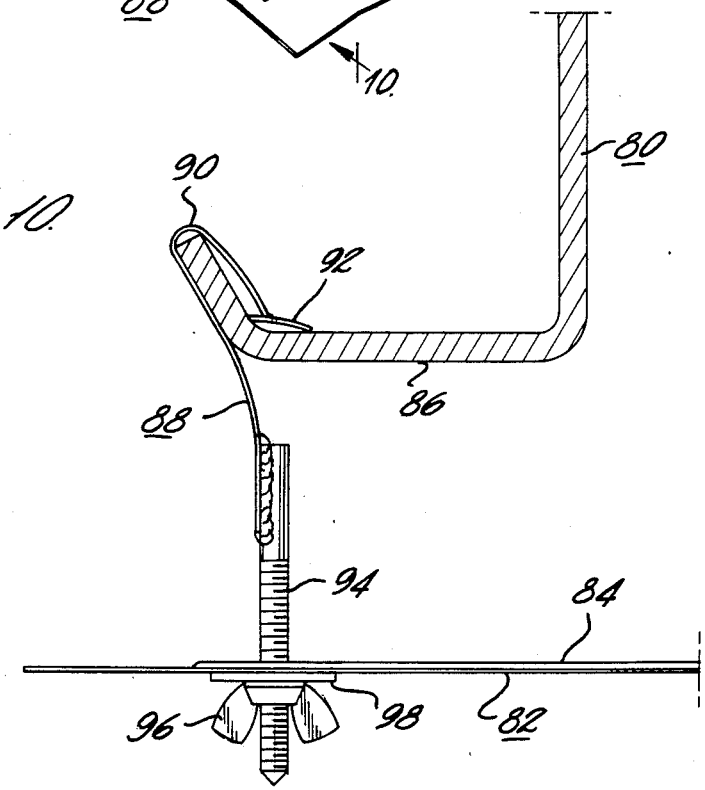
FIG. 10 is a view of the hanger form shown in FIG. 10, this form replacing hanger spikes as hereinbefore shown, and useable in either disposition of the insulation layer.

Reference is here made to FIGS. 9 and 10 of the drawings. These figures disclose a modified installation in which purlins 80 are again mounted in the structure as in the preceding embodiment. The insulating material, not shown, and the facing layer 82 are run or installed in a direction parallel to the purlins. This type of installation serves to overcome a possible mismatch which could result in gaps between the material and the purlins due primarily to an improper and inexact spacing of the purlins. In such a case, it is conceivable that the support means or hangers such as the spikes would not serve to support the material. With the facing layer and insulating layers being run in directions parallel to the purlins, this possibility is overcome. It is noted from FIG. 9 that support strips 84 are again operatively attached to the facing and the sheet is of such width as to overlap the lower purlin lip 86. In lieu of the use of hanger spikes, a hanger as specifically shown in FIG. 10 can be used. This hanger, generally indicated 88, is preferably formed of a springy material such as metal in strip form and includes an upper hook at 90 which can include an end plate or segment 92 adapted for supportive placement on the surface of purlin lip 86 with the remainder of the hanger depending therefrom. The lower portion or segment of the hanger 10 consists of a threaded bolt-like portion 94 which is welded or otherwise secured to the lower end of the upper hanger part. During installation of the material, using the form of hanger disclosed in FIGS. 9 and 10, the threaded lower end or portion 94 is forced through the material consisting of batts or layers of insulating material and the facer or facing 82 at the position of support strips 84. A wing nut or the like 96 is threadedly engaged on the threaded bolt and with a selective use of a washer means 98 serves to support and interengage the materials.

It is to be noted that the specific hanger or suspension means can be varied as also can the direction of placement of the sheets with respect to the purlins and such constructions are to be considered as a part of the present invention.

It is thus seen that the underlying concept of the present invention lies not only in the construction of the vapor barrier sheet as a laminated multiple layer element but also teaches the use of the vapor barrier and portions of the construction for either a new building, or to add additional insulation to an old structure, and to effectively seal the insulation against moisture penetration.

While preferred structures have been shown and described in detail, obviously various dimensions can be altered and certain minor changes made without departing from the spirit and scope of the invention. The foregoing description of components of the embodiment, and as shown in the drawings, serves as a teaching for one skilled in the art to utilize the concepts and structure of the invention. Obvious changes or modifications are considered to be within the scope of the inventive concept as expressed herein, and as claimed hereinafter.

What is claimed is:

1. A reinforced laminated layer vapor barrier material for being supported by fasteners at a plurality of mounting points in a building interior comprising a bottom moisture resistant material facing sheet, an uppermost backing sheet, an intermediate strengthening fiber array layer being constituted by a plurality of layers of strips of synthetic fibers of generally the same cross section and arranged in a criss cross diamond array to provide multi-directional strength, a plurality of laterally disposed and longitudinally spaced fastener engaging support strips of greater cross section than said synthetic fibers and integrally formed in the laminated layer intermediate said fiber array layer and said bottom sheet, an adhesive interconnecting all layers into a cohesive selfsupportive, layered and laminated vapor barrier material.

2. A laiminated layer vapor barrier material as claimed in claim 1 and adapted for operatively supporting layered insulating material to the interior underside of a building structure roof including a plurality of spaced longitudinally extending purlins and a plurality of supporting hangers attached on and depending from the purlins, the vapor barrier material being adapted to be interengaged with and mounted to said hangers by interengagement support between the supporting strips and supporting hangers, the vapor barrier, as installed, actively preventing energy leakage from a building, and moisture intrusion to said insulation.

3. A material as claimed in claim 2, said hangers consisting of pointed spikes fixed to said purlins.

4. A laminated layer vapor barrier material as claimed in claim 2, said hangers comprising a strip of material having an upper hooked end adapted for suspension on a said purlin, a bolt extended from the lower end of said strip and adapted for penetration through said material layer and means operatively engaged on said bolt and engaging the lower material surface for support of said laminated layer.

5. A laminated layer vapor barrier material as claimed in claim 4, said bolt being threaded and engaged by a threaded nut means.

6. A laminated layer vapor barrier material as claimed in claim 1, said supporting strips consisting of thin supportive material imbedded in the layered structure.

7. A laminated layer vapor barrier material in a building structure as claimed in claim 2, wherein the building is usually of metal structure often with purlins and the like consisting of parallel disposed angularly-shaped longitudinal members, said supporting hangers being affixed to the undersides of said purlins, and including an additional bottom layer of insulating material disposed between the underside of bottom legs on said purlins, with the hangers extending therethrough, a fastening member engaged on the lower end of each said hanger and supportively mounting all said layers and said added bottom layer of insulating material to the purlin structure.

8. The structure of claim 7, wherein said bottom layer of insulating material having said vapor barrier material thereon serves to space said vapor barrier material away from said purlins, to thereby prevent heat transfer to or from said insulating material through said purlins.

9. In combination, a reinforced laminated layer vapor barrier material for being supported by fasteners at a plurality of mounting points in a building interior comprising a bottom moisture resistant material facing sheet, an uppermost backing sheet, an intermediate strengthening fiber array layer being constituted by a plurality of layers of strips of synthetic fibers of generally the same cross section and arranged in a criss cross diamond array to provide multidirectional strength a plurality of laterally disposed and longitudinally spaced fastener engaging support strips of greater cross section than said synthetic fibers and integrally formed in the laminated layer intermediate said fiber array layer and said bottom sheet, an adhesive interconnecting all layers into a cohesive selfsupportive, layered and laminated vapor barrier material, said structure having a plurality of spaced longitudinally extending purlins, interconnected with the building structure, a plurality of affixed supporting hangers depending from the purlins, a batt of insulating material disposed between said purlins and said laminated vapor barrier, said vapor barrier being mounted over the external surface of said insulating batt of insulating material wherein said supporting strips are aligned with said hangers, said arrangement spacing said laminated vapor barrier from said purlins and preventing heat transfer therethrough.

10. The combination of claim 6, wherein said laminated vapor barrier is formed in elongated strips adapted for side-by-side positionment to cover the underside of a building roof, said sheets having a strip of contact adhesive along one side edge thereof, a peel off cover strip on said adhesive strip, said sheets when mounted to a roof having said peel off strip removed and the one edge strip of contact adhesive being operatively contacted and sealingly engaging said adjacent edges and preventing moisture passage between said joined and sealed sheets.

11. The combination of claim 10, including retainers mounted on the free ends of said hangers, exteriorly of said facing sheets, and said laminated vapor barrier sheets being thereby integratedly supported and capable of supporting additional layers of insulating material on said hangers and below said building roof.

12. The combination of claim 11, and including top and bottom additional layers of insulating material respectively disposed above and below the upper and lower ends of said purlins and serving to inhibit heat transfer or passage to the exterior of the insulating layers from said purlins and the metallic roof and building structure interior.

* * * * *